United States Patent [19]

Mansfield

[11] 3,977,385

[45] Aug. 31, 1976

[54] INTERNAL COMBUSTION ENGINES WITH STRAIGHT LINE REINFORCING MEMBERS BETWEEN CYLINDER HEADS AND MAIN BEARINGS

[75] Inventor: Wilfred Percival Mansfield, Chandlers Ford, England

[73] Assignee: National Research Development Corporation, London, England

[22] Filed: June 12, 1974

[21] Appl. No.: 478,886

[30] Foreign Application Priority Data

June 21, 1973 United Kingdom ..... 29500/73

[52] U.S. Cl. ..... 123/195 R; 123/59 R

[51] Int. Cl.[2] ..... F02F 7/00

[58] Field of Search ..... 123/193 C, 195 R, 59 R

[56] References Cited

UNITED STATES PATENTS

| | | | |
|---|---|---|---|
| 1,187,737 | 6/1916 | Isham | 123/195 R |
| 2,578,079 | 12/1951 | Meinertz | 123/195 R |
| 3,183,794 | 5/1965 | Hind | 123/195 R X |
| 3,674,000 | 7/1972 | Reisacher et al. | 123/193 C X |

*Primary Examiner*—Charles J. Myhre
*Assistant Examiner*—William C. Anderson
*Attorney, Agent, or Firm*—Cushman, Darby & Cushman

[57] ABSTRACT

An internal combustion engine structure in which the tendency of the combustion forces to separate the cylinder head from the crankshaft bearings is resisted by external tie-rod structures attached at opposite ends to engine structure adjacent these two parts. The tie-rods run as nearly as possible in straight lines, and therefore typically lie obliquely to the crankshaft axis and to the transverse planes containing the cylinder axes. The tie-rod structures may be ribs or fins and may also be attached to parts of the engine wall intermediate their ends to make those parts more rigid.

7 Claims, 3 Drawing Figures

INTERNAL COMBUSTION ENGINES WITH STRAIGHT LINE REINFORCING MEMBERS BETWEEN CYLINDER HEADS AND MAIN BEARINGS

This invention relates to internal combustion engine structures. In particular it relates to the structure of engines of the kind described generally in the provisional specification of U.S. Pat. application No. 478,885, filed June 12, 1974, now abandoned. A notable feature of such engines is the absence of the customary extensive cooling system which involves a jacket enclosing the entire cylinder block on all sides. In such systems water flows constantly through the space between the jacket and the block and cools the whole block. The engines described in the specification of the above mentioned Patent are distinguished by a far less extensive cooling system; in such engines, forced-flow cooling systems are confined to those parts of the engine, especially the cylinder block and cylinder head, where they are essential to prevent heat damage. The specification explains how this type of construction reduces the size of radiators, fans, etc., and may achieve greater efficiency by avoiding heat losses caused by the known, less discriminating cooling systems, and leads to engine structures that are less prone to radiate sound.

The specification also describes ways of improving the quietness of the engine by adding fins or the like to make the walls more rigid. Such fins can also act as tie-bars between the upper regions of the engine where combustion takes place and the lower regions where the resulting piston forces are transmitted to the crank shaft.

The present invention concerns an improvement in the disposition of such fins or like reinforcing structures. According to this improvement the ribs or other load-carrying members are so disposed that substantially all the cylinder gas pressure forces applied to the cylinder head are carried in straight lines to the main bearing caps where the opposing forces are applied via the piston, connecting rod and crankshaft. By carrying the forces rectilinearly from the loaded central area of each cylinder head to the two adjacent main bearings, for instance via sloping ribs, the bending moments which are the cause of the normal noise-producing bending deflections of engine surfaces may be reduced. Such ribs may also serve to make the structure rigid and thus reduce the effect of secondary noise-exciting forces. In a typical engine in which the cylinder axes lie in parallel transverse planes each lying at right angles to the crankshaft axis, the main bearing caps will be coaxial with the crankshaft and lie between the transverse planes of the cylinder axes. The ribs will thus lie obliquely both to the transverse planes and to the crankshaft axis.

In one form of construction, the said ribs are integral extensions of ribs bracing the cylinder heads. This form can be used when the cylinder block and cylinder heads are formed as a single integral unit. If the cylinder head is a separate component, bosses to accommodate studs or bolts may be formed as projections from the sides of aligned ribs on the cylinder block and head; the studs or bolts may then connect block and head and carry the gas loads through the composite ribs as in the integral construction. At their end adjacent the main bearing caps, the ribs may either be integral with the crankcase housing, to which the caps are usually bolted, or they may be attached directly or indirectly to the crankcase, for instance by being bolted to it or to bosses or the like mounted on it.

The engine cylinders may preferably be formed integrally with the rest of the cylinder block, and the oblique ribs may be attached to them, thus making them more rigid.

The invention is further defined by the claims that conclude this specification, and will now be described, by way of example, with reference to the accompanying drawings in which:

Figure 1:
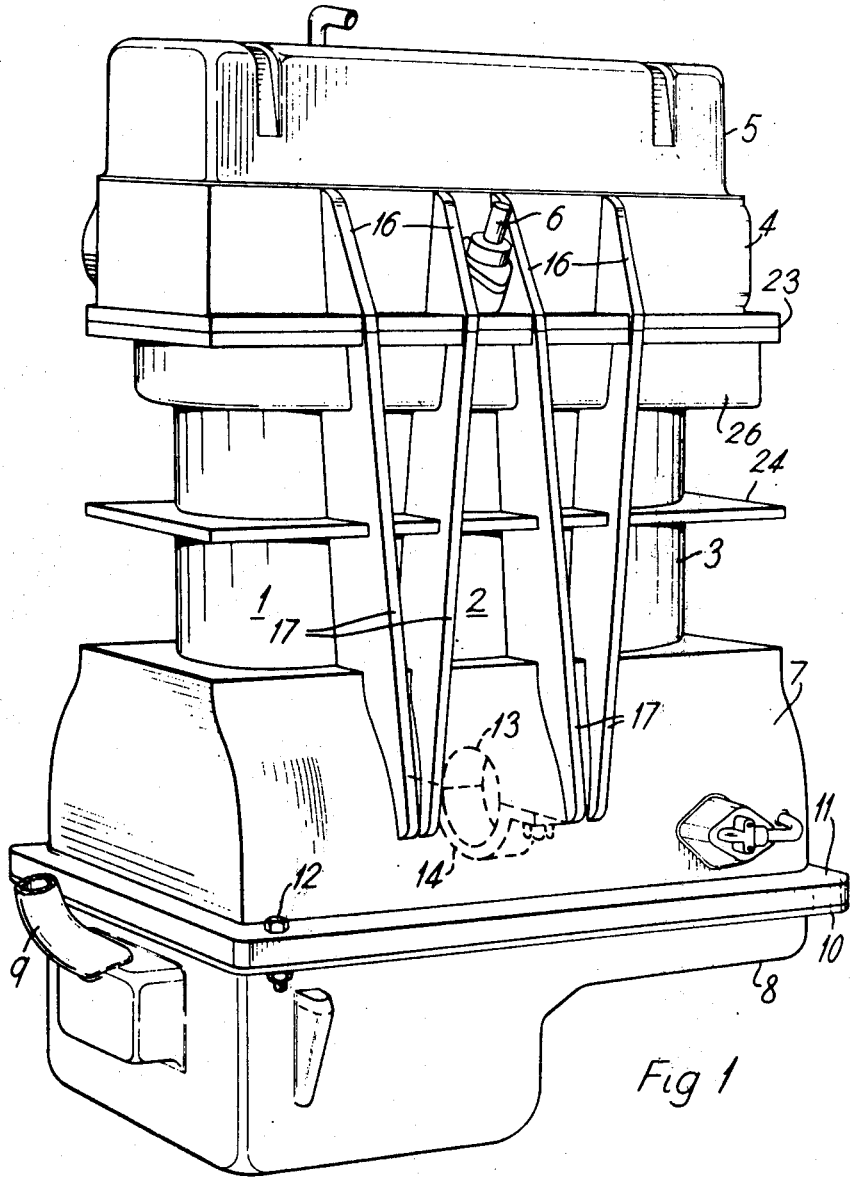
FIG. 1 is a perspective view of a model engine.
Figure 2:
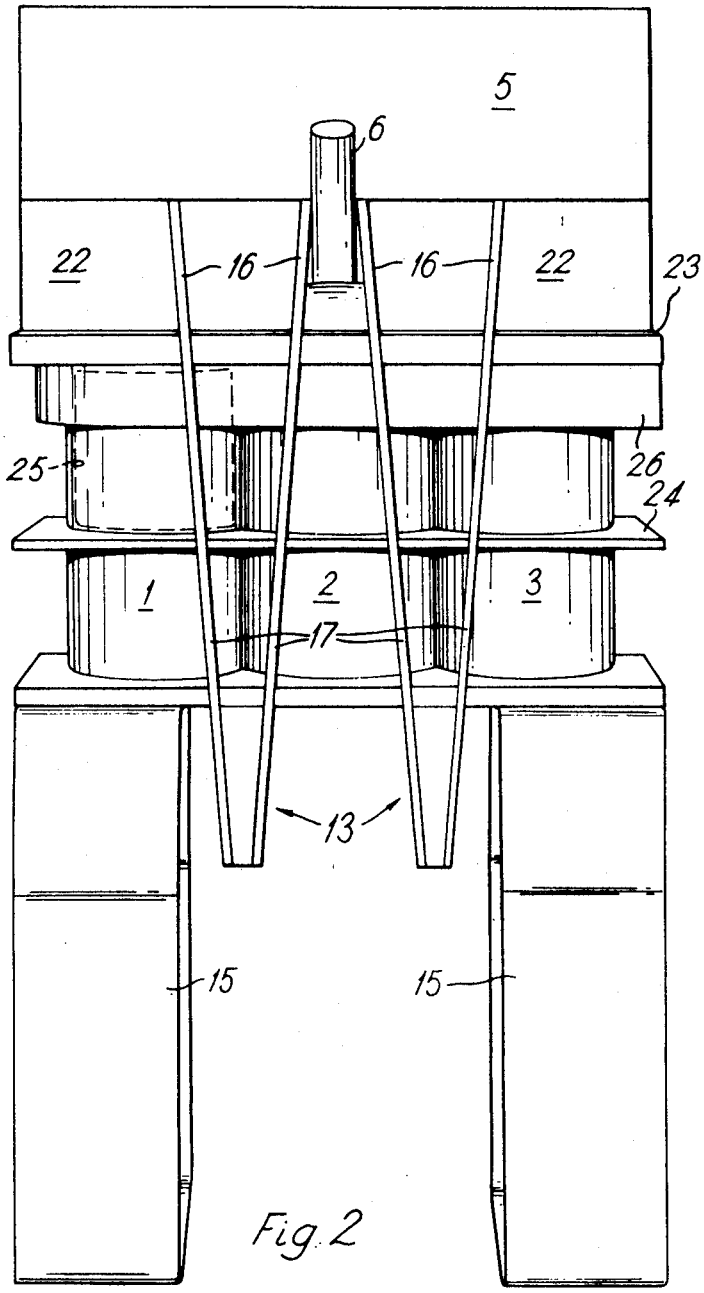
FIG. 2 is a side elevation of a more diagrammatic version of the same engine.
Figure 3:
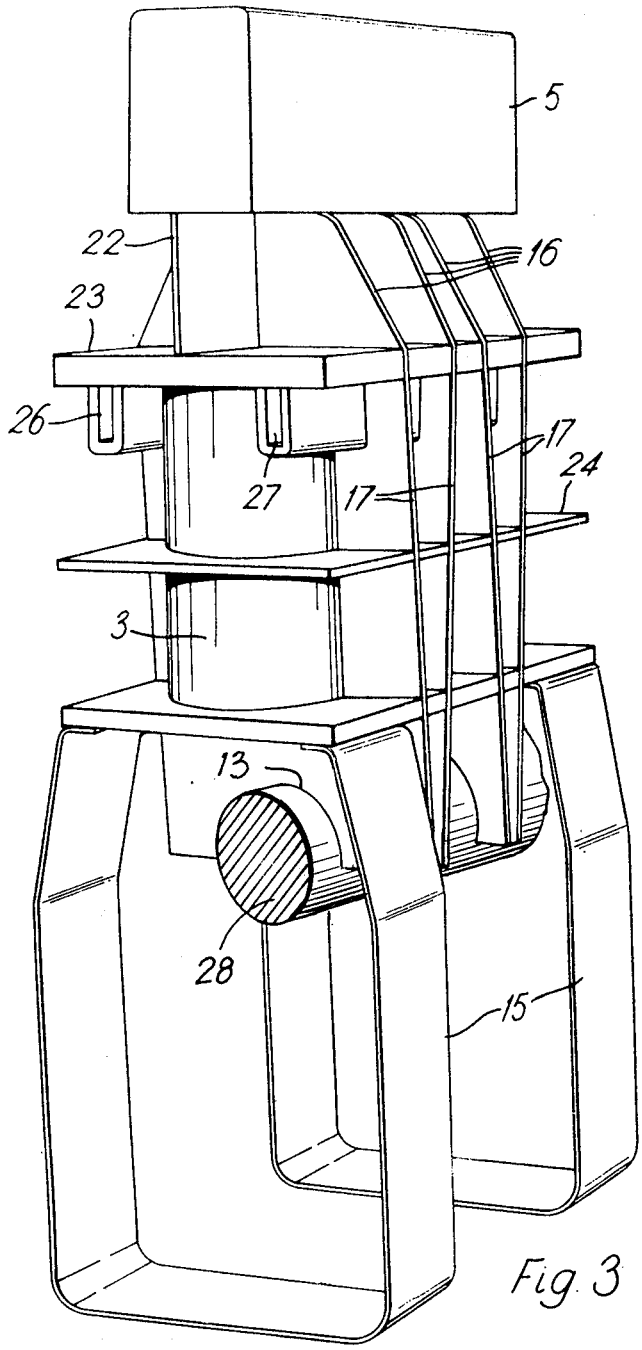
FIG. 3 is a perspective view of the version shown in FIG. 2.

The model diesel engine shown in the drawings comprises an integral cylinder head and block unit including three in-line cylinders 1, 2 and 3 surmounted by the cylinder head 4, a valve cover 5 and the usual injectors 6, of which only one is shown. The crankcase 7 carries a sump 8 with an oil filler 9 as usual, and a flange 10 at the top of the sump meets a corresponding flange 11 at the base of the crankcase in a gasketted joint, held together by a set of bolts 12 of which only one is shown. The crankcase carries main bearing halves 13, to which the pads 14 constituting the other halves are bolted in the usual way, the bearing halves mounting crankshaft 28 shown schematically in section in FIG. 3. The strap-shaped members 15 shown in FIGS. 2 and 3 are merely schematic cut-away representations of the crankcase and sump as shown in full in FIG. 1.

Ribs 16 on the cylinder head are so placed that most of the gas pressure load applied to cylinder head 4 by combustion within cylinders 1, 2 and 3 is transmitted to them and bending of the cylinder head structure by these loads is minimised. The ribs 16 lie in the transverse planes of the cylinder axes, and thus lie along the line of the reactions that the firing forces within the cylinders exert upon the cylinder head. Integral extensions 17 of ribs 16 extend down both sides of the block, and the inner edges of extension 17 are attached to the exposed outer surfaces of the lower parts of cylinders 1 to 3, thus improving their rigidity and strength and lessening their tendency to radiate noise. The rib extensions 17 merge into the outer surface of the crankcase at points corresponding transversely to the location of the bearing halves 13 against the inner surface. Thus the straight line of each rib-like reinforcement member comprising 16 and 17, linking the cylinder head to the main bearing caps so that the combustion forces are transmitted from one to the other in a straight line, lies at an oblique angle to the crankshaft axis and to the transverse planes including the axes of cylinders 1 – 3. A longitudinal vertical rib 22 on the cylinder head, (shown in FIGS. 2, 3 - it would lie entirely inside cover 5 in FIG. 1) and upper and lower decks (i.e. horizontal ribs) 23, 24 and the flanges 10, 11 stiffen the structure. The lower deck 24, attached to the outer walls of cylinders 1 – 3 where it surrounds them and to rib extension sections 17 where it crosses them, may lie close to the level where the bottom edge of the piston (25, FIG. 2) lies just after top dead centre of its stroke. This is one of the levels at which the piston is most likely to knock against the cylinder wall, and the extra stiffness here will help significantly to deaden the sound of this knocking.

Immediately below the upper deck 23 an inlet manifold 26 for a driven supply of cooling water supplies water through annular paths around each cylinder, these paths being of small dimension in the direction of the axes of their respective cylinders and being located close to the combustion zones of the cylinders. Manifold 26 also supplies water to channels (not shown) extending across the regions of the cylinder head where thermally critical regions, for example the injector inlet and the exhaust valves and valve guides, are situated. The water is returned to a radiator or other suitable heat-exchanger via a water outlet manifold 27.

The diagrammatic drawings show only those ribs 16 and rib extensions 17 that link the cylinder head to the two central main bearings of the engine. In practice, in a three-cylinder engine as shown, there would often be two further main bearings, one at either end, and there would therefore be further oblique ribs linking the head to these bearings.

In the construction described the ribs have made connection with the main bearings through the structure of the crankcase, and mention has been made of the extra stiffness given to the engine by the joint of flanges 11 and 10. However alternative constructions are possible, and may be desirable, in which the ribs are more directly connected to the main bearings and the crankcase is structurally more isolated from both of them, for instance by being attached to the cylinder block by a sealed but flexible joint. Such an alternative could be desirable if the crankcase were of a construction specially prone to noisy vibration.

I claim:

1. An internal combustion engine structure comprising:

a crankshaft;

a plurality of cylinders;

pistons arranged to reciprocate within said cylinders and impart drive to said crankshaft;

the axes of said cylinders being offset from each other in the direction of the axis of said crankshaft, so as to each lie in a different transverse plane relative to said crankshaft axis;

a cylinder head surmounting each of said cylinders, and each forming the head of a combustion zone for that cylinder;

main bearings supporting said crankshaft and located in transverse planes relative to said crankshaft axis and intermediate those of the axes of said cylinders;

reinforcement members each extending in a straight line and joining said cylinder heads to said main bearings in a straight line, whereby to withstand the tendency of the engine firing forces to separate them; and said reinforcement members being connected to said cylinder heads at locations corresponding closely with said transverse planes of the said cylinder axes, and to said bearings at locations corresponding closely with their own transverse planes, whereby each reinforcing member lies oblique relative to said transverse planes.

2. An internal combustion engine structure according to claim 1 in which the said cylinder heads constitute parts of a unitary cylinder head structure for the whole engine.

3. An internal combustion engine structure according to claim 1 in which said members are in the form of ribs projecting transversely from the structure, the inner edges of the ribs being attached to the outer wall of the structure at least at intervals over the length of the members.

4. An internal combustion engine structure according to claim 1 including a crankcase upon which said main bearings are mounted, and in which said reinforcement members are composite structures including one end part comprising a stiffening rib formed on said cylinder heads and an opposite end part attached to said crankcase.

5. An internal combustion engine structure according to claim 1, in which a substantial length of the outer wall of each cylinder is exposed to atmosphere, and in which said reinforcement members are attached to said outer walls over said length, thus serving also to make said walls more rigid.

6. An internal combustion engine structure according to claim 5 in which:

the axes of said plurality of cylinders are parallel and lie in a common plane;

a reinforcing plate attached to the exposed cylinder walls makes them yet more rigid;

said reinforcing plate lies at right angles to the cylinder axes;

said plate is also attached to the said reinforcement members.

7. An internal combustion engine structure according to claim 6 in which at least one such plate is attached to all said cylinders at a level corresponding to that of the lower edge of the pistons just after top dead centre.

* * * * *

UNITED STATES PATENT OFFICE

CERTIFICATE OF CORRECTION

Patent No. 3,977,385 Dated August 31, 1976

Inventor(s) Wilfred Percival MANSFIELD

It is certified that error appears in the above-identified patent and that said Letters Patent are hereby corrected as shown below:

In the heading:

Please add to Item [30] the following omitted Foreign Application Priority Data:

December 18, 1973 Great Britain..... --58491/73

Signed and Sealed this

Fifth Day of April 1977

[SEAL]

*Attest:*

RUTH C. MASON
*Attesting Officer*

C. MARSHALL DANN
*Commissioner of Patents and Trademarks*